US006494751B1

(12) United States Patent
Morello et al.

(10) Patent No.: US 6,494,751 B1
(45) Date of Patent: Dec. 17, 2002

(54) TERMINAL-SIDE LOCKING ELECTRICAL HEADER CONNECTOR

(75) Inventors: John R. Morello, Warren, OH (US); Jon C. Hobbs, Burghill, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/910,525

(22) Filed: Jul. 20, 2001

(51) Int. Cl.[7] ..... H01R 13/514; H01R 13/40
(52) U.S. Cl. ..... 439/752; 439/595
(58) Field of Search ..... 439/752, 595, 439/587, 852, 748, 834

(56) References Cited

U.S. PATENT DOCUMENTS 4,842,525 A * 6/1989 Galloway et al. ..... 303/119.3
5,641,314 A * 6/1997 Broschard et al. ..... 439/733.1
6,099,361 A * 8/2000 Takanashi ..... 439/751
6,126,495 A * 10/2000 Lolic et al. ..... 439/752.5
6,149,462 A * 11/2000 Sugie ..... 439/595

* cited by examiner

*Primary Examiner*—Brian Sircus
*Assistant Examiner*—Chandrika Prasad

(74) *Attorney, Agent, or Firm*—Thomas N. Twomey

(57) ABSTRACT

A multiple cavity electrical header connector and associated box-type female terminal. The header is made in a one-piece as an injection molded connector body having a generally rectangular cross sectional configuration and a low-profile when mounted with its longitudinal axis parallel to the planar mounting surface of an associated printed circuit board. The header front face mates with a system module with male terminal blades protruding therefrom to be individually received in the female terminals individually carried in the header cavities. The header connector body is side-cored to provide resilient flex lock arms integrally joined to the header body that in their free state protrude one into each cavity space. Each arm is yieldably flexed back by an associated terminal when such is inserted into the cavity, and then snaps out and holds the terminal locked in its cavity. The header cavities are arranged in two parallel rows with their blade entrances opening to the header front face. An integral soldertail forms an asymmetric extension of each terminal top wall and protrudes from the header rear face for insertion into an associated printed circuit board opening. A downwardly protruding tang of the terminal provides an abutment edge for locking engagement with the flex lock arm free end. Two blind-end slots in the header at each cavity slidably individually receive the terminal locking tang and a protruding guide fin of the terminal during telescopic terminal assembly into its header cavity.

8 Claims, 7 Drawing Sheets

TERMINAL-SIDE LOCKING ELECTRICAL HEADER CONNECTOR

FIELD OF THE INVENTION

The present invention relates generally to electrical connectors and more specifically to cavity-type header connectors for receiving female terminals.

BACKGROUND OF THE INVENTION

Multiple cavity headers are conventionally used in automotive electronic circuitry construction for receiving and mounting female terminals, and wherein the header is mounted to a printed circuit board and the header receives mating male blades of an associated electrical module for thereby making electrical and mechanical connection of the module to the printed circuitry. Multiple cavity headers that are made in one piece conventionally require that the female terminal part have a protruding spring tang that will lock the terminal into the header cavity when telescopically inserted fully therein. Such tang type terminals, however, present problems in terms of breakage of the protruding tangs during part handling and other operations in the manufacturing process, as well as during installation and hook-up of circuitry components. This renders their mounting and ultimate electrical connection in the circuitry less than fully reliable and cost effective. In addition the coring required to produce the internal cavity structure for receiving the tang-type female terminal requires a large opening in the header face that receives the terminal blade from the module. This causes insertion problems and misalignment in making the push-in type connections to the header-installed female tang terminals.

On the other hand, tangless female terminals have been provided, but in order to achieve secure retention of the same in a molded plastic header, hitherto the header has had to be made in two pieces with mating half cavities formed in each mating and mutually juxtaposed faces of the two header pieces. With this two-piece construction the tangless terminals can be individually sandwiched between the two header parts and the same locked together by some type of locking structure to thereby retain the tangless female terminal in the header. However, this type of two-piece header construction increases the manufacturing labor costs and also incurs additional manufacturing costs in tracking the two pieces into an assembly of the same as well as requiring additional tooling costs in the molding of the pieces. In addition, the manufacturing of the header in two parts increases the tolerance stack-up associated with the nose piece typically used with a tangless terminal that can lead to misalignment with the mating blades of a module as well as in coupling to the printed circuit board.

OBJECTS OF THE INVENTION

Accordingly, among the objects of the present invention are to provide an improved cavity-type header electrical connector adapted for receiving and retaining a tangless female terminal that overcomes one or more of the aforementioned problems.

Another object is to provide an improved one-piece header connector having multiple cavities for individually receiving female connectors that overcomes the problems of two-piece headers and in which the header structure provides easy, snap-in spring tang retention for female terminals individually received in cavities of the header, thereby eliminating the need for providing a spring barb type tang on the female terminal.

Another object is to provide an improved female terminal with an integral solder-tail that protrudes from the header for insertion into a printed circuit board and that is designed for cooperation with the improved aforementioned multiple cavity single piece header connector.

Another object is to provide an improved header connector of the aforementioned type which has an improved insertion entrance way for guiding the male blade of a cooperative module into the interior electrical contact structure of the female terminal as the latter is held captured and reliably and accurately positioned in the header cavity.

SUMMARY OF THE INVENTION

As shown in simplified semi-diagrammatic form in FIG. 13–16, the terminal receiving cavity 104 is shown with the female soldertail terminal 118 received therein, fully inserted in assembled condition and locked in place in the cavity 104 by the header cavity spring finger 120. Opening 116 is formed by a retractable side core in the injection molding tooling which cooperates with retractable end coring used to form the main cavity 104. Thus, spring finger 120 is integrally joined at one end 122 to the main body portion of header 100 and projects substantially toward the mating face 102 (FIG 14). Finger 120 is constructed and arranged to spring out to a flexed or retracted position or state 123 and spring back to a free or locked position or state 121 in order to capture the terminal box of each terminal 118 with only about a 0.2–0.5 mm deflection travel range in order to reliably capture the terminal 118 within the cavity 104, 106. Because the deflection of the finger 120 is minimal, the header 100 and finger 120 can be molded of a composite material containing glass fibers or of a glass-filled and reinforced plastic injection molding material (shown in FIG. 14). Side lock arm 120 is deflected outward by the leading edge and side of terminal 118 as it is being inserted telescopically into the cavity 104, 106 during initial assembly thereof into the header 100. The free end 124 of side lock arm 120 thus forms a locking spring tang which cooperates with a locking tab 126 provided on the mutually facing side of terminal 118, as best seen in FIG. 14.

Preferably each female terminal is a progressive die formed and bent box type having parallel top and bottom walls and parallel opposite side walls with internal opposed fixed and spring contacts for cooperating with the associated mating blade of the module. An integral soldertail terminal is formed as an asymmetric extension coplanar with the top wall of the terminal box and protruding from the rear face of the header for insertion into an associated openings in the printed circuit board array. Each terminal has a protruding tang and an associated adjacent space in one of its side walls for receiving the free end of the associated flex lock arm of the header in assembled and locked position. The tab provides an abutment edge for locking engagement with the free end of the flex lock arm. Each terminal also has a fin or keel protruding from its top wall in a direction opposite to the protrusion of the locking tang. The header has blind-end slots for slidably individually receiving the terminal fin and locking tab during telescopic terminal assembly into the associated header cavity. Each header cavity has an entrance way in the header front face, for receiving the mating blade of the module, in the form of a rectangular opening having four beveled edges for guiding insertion of the free end of the blade into the associated terminal captured in the cavity.

BRIEF DESCRIPTION OF THE DRAWINGS

The foregoing as well as other objects, features and advantages of the present invention will become apparent to those skilled in the art from the following detailed description of exemplary but preferred embodiments of the invention and the best mode of making and using the same presently known to the inventors, from the appended claims and from the following drawings as referenced in the description (which are to engineering scale unless otherwise indicated), wherein:

DETAILED DESCRIPTION OF THE PREFERRED EMBODIMENTS

Figure 1:
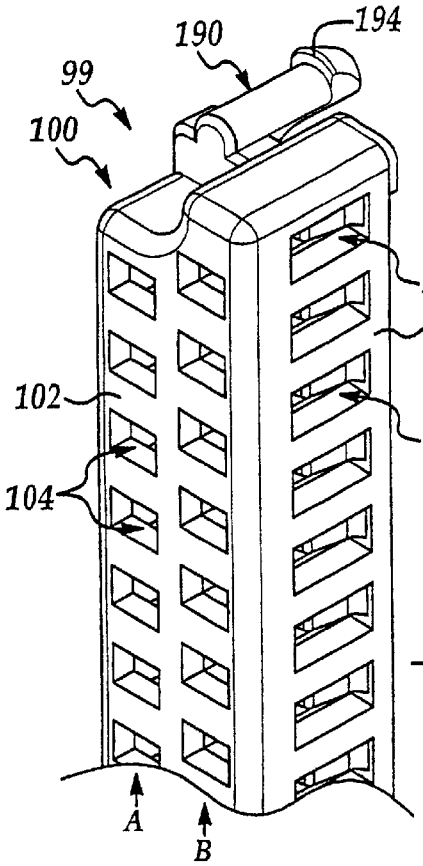
FIG. 1 is a fragmentary perspective view of an improved multiple cavity header type electrical connector constructed in accordance with the invention.

Referring in more detail to the accompanying drawings, an exemplary and preferred embodiment of an electrical header connector 99 having a multiple cavity female header or body 100 and a series of female soldertail terminals 118 housed therein is illustrated in FIGS. 1 through 16. Within its environment (not shown), the header connector 99 engages electrically between an electronic module and a printed circuit board. The electronic module has male terminals or blades which insert into the female terminals 118 of the header connector 99, and the printed circuit board has blade receptacles or openings which receive blades 154 of the female terminals 118 which project outward from the header 100. Typically, once the receptacles are in receipt of the blades 154, the blades are then soldered to the printed circuit board.

Preferably header 100 is constructed in one piece of a suitable plastic material and preferably made by injection molding processes and equipment on a mass production basis to achieve precision manufacture to close tolerances on an economical basis. Header 100 is rectangular in cross sectional configuration perpendicular to its longitudinal axis 101 and is elongated longitudinally so as to have a high aspect ratio. Hence when header 100 is mounted with its longitudinal axis 101 disposed parallel to the planar mounting surface of the printed circuit board (not shown), the header offers the low-profile characteristics of the header connector 99.

Figure 2:
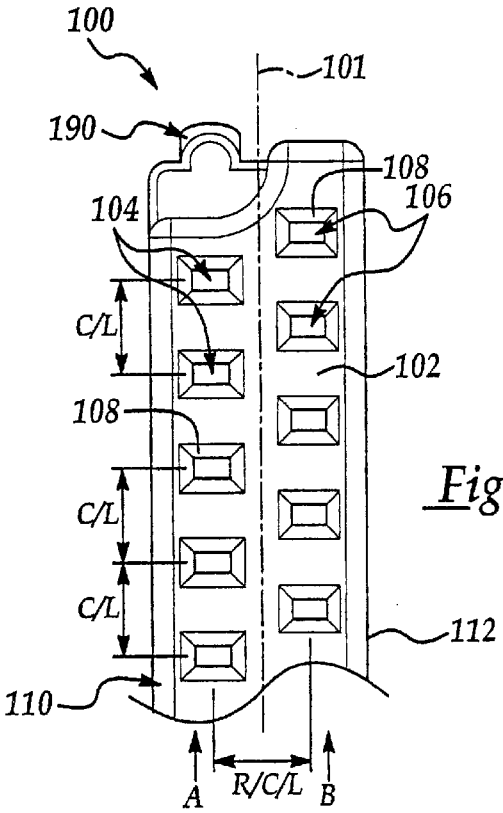
FIG. 2 is a fragmentary front elevational view of the header as shown in FIG. 1.
Figure 4:
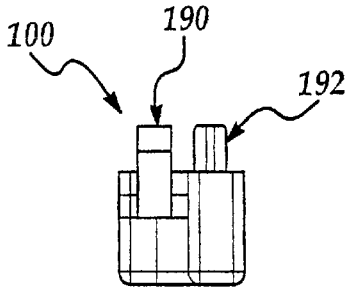
FIG. 4 is an end view of the header as shown in FIG. 5.
Figure 5:
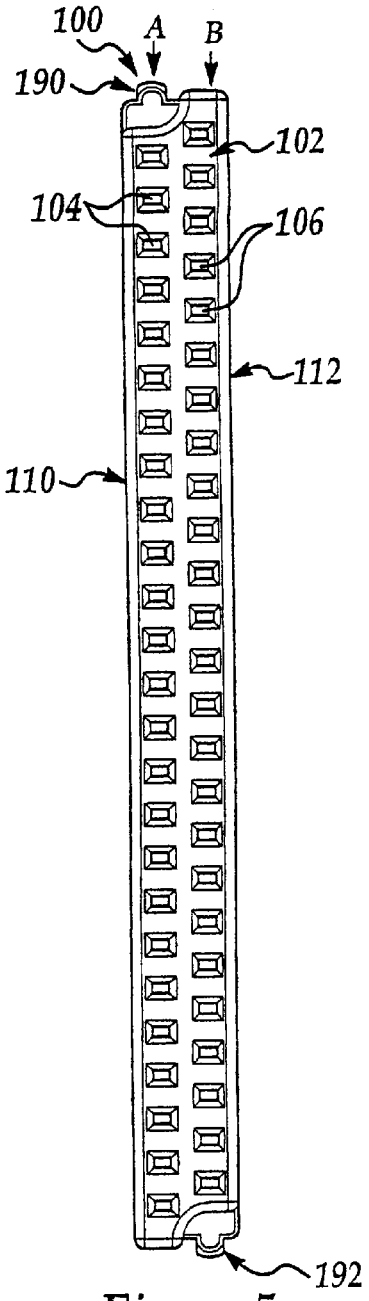
FIG. 5 is an elevation view of the male-blade-receiving side of the header of FIGS. 1–4.
Figure 7:
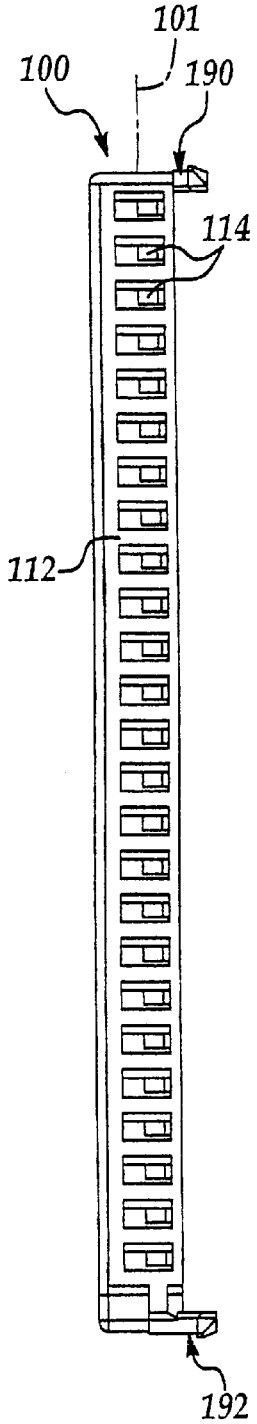
FIG. 7 is an elevational view of the side (the "row B side") of the header opposite to that of FIG. 3.
Figure 8:
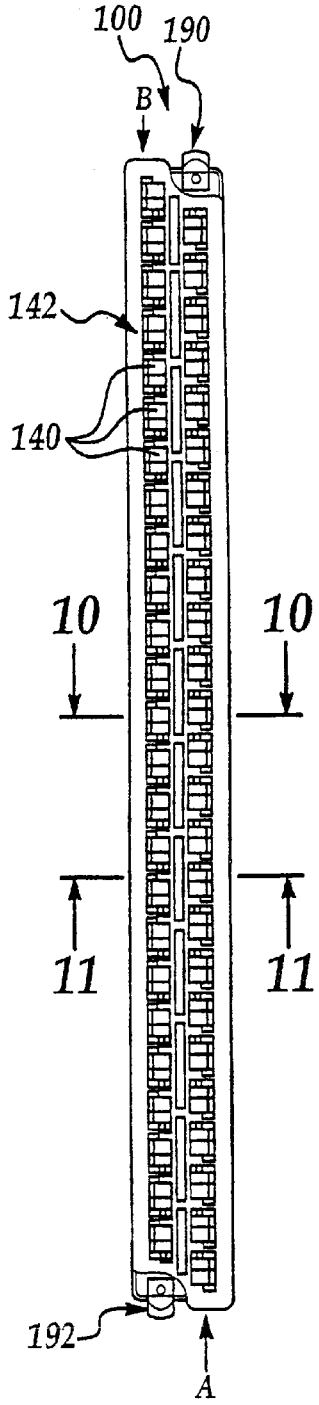
FIG. 8 is an elevational view of the header of FIGS. 1–7 as viewed from the side that mates to the associated printed circuit board and from which protrude the solder-tails of the female terminals received in the header.
Figure 6:
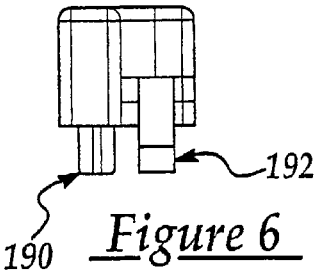
FIG. 6 is an end elevational view of that end of the header juxtaposed thereto in FIG. 5.
Figure 10:
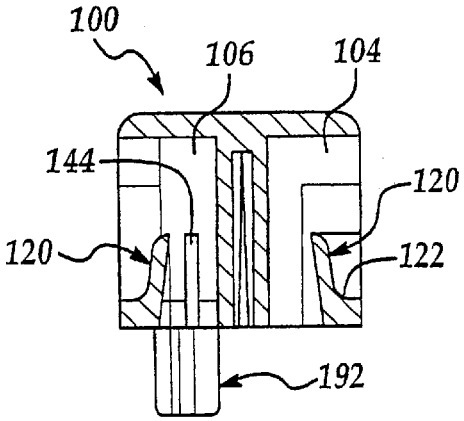
FIGS. 10, 11 and 12 are cross sectional views taken on the lines 10—10, 11—11 and 12—12 of FIG. 8 (FIG. 12 being a fragmentary view).
Figure 11:
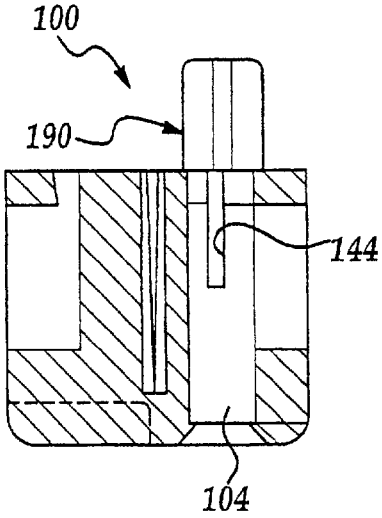

In the disclosed example, header connector 99 is configured as a 50-way header connection adapted to mate up to a 50-blade electronic module to a Mercedes Benz relay center. For this purpose, a mating face 102 of header 100 is provided with two longitudinally extending rows of twenty-five terminal receiving cavities arranged side by side but staggered longitudinally along the header. The two longitudinal rows of cavities are designated A and B in FIGS. 1, 2 and 5. Cavities 104 of row A and cavities 106 of row B communicate through the mating face 102 forming openings or ports carried by face 102 which have a rectangular configuration with 45 degree lead-in chamfers 108 on each of the top, bottom and side edges of each opening to provide smooth lead-in guide surfaces for the male blades of the electronic module that is to be so mated to the header. The longitudinal centerline-to-centerline cavity spacing from one cavity 104 to the next in row A, designated CL in FIG. 2, is preferably identical (and likewise in row B), and by way of example is in the order of 5.0 mm. The lateral row-to-row centerline spacing is designated R/C/L in FIG. 2, and also is in the order of 5.0 mm in the preferred example.

Figure 3:
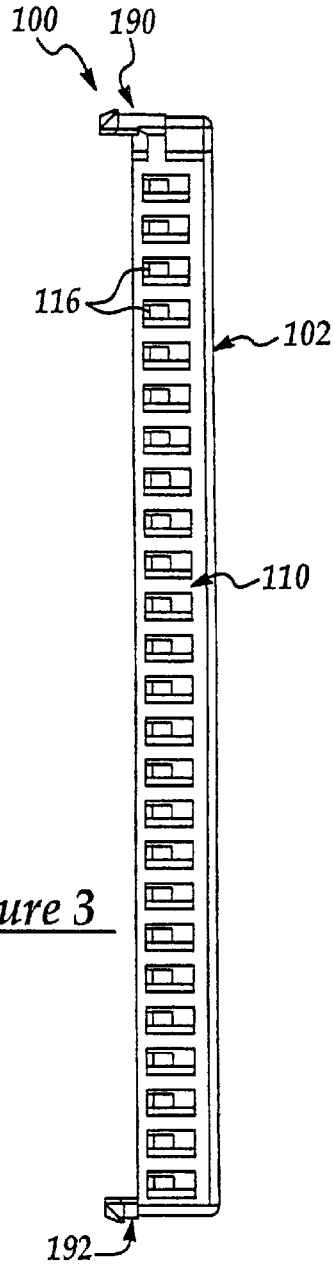
FIG. 3 is an elevational view of one side (the "row A side") of the header of FIGS. 1 and 2, with the header being shown complete.

In accordance with one of the principal features of the present invention, each header cavity 104, 106 contains an integral and unitary terminal-locking spring finger 120. In order to accomplish this molded construction, the opposite lateral sides 10 and 112 of header 100 are molded using side coring to provide a side opening or bore 114 for each of the cavities 106 in row B (FIG. 1). Likewise, side openings or bores 116 are cored in side 110 to individually register with the cavities 104 in row A (FIG. 3).

Figure 13:
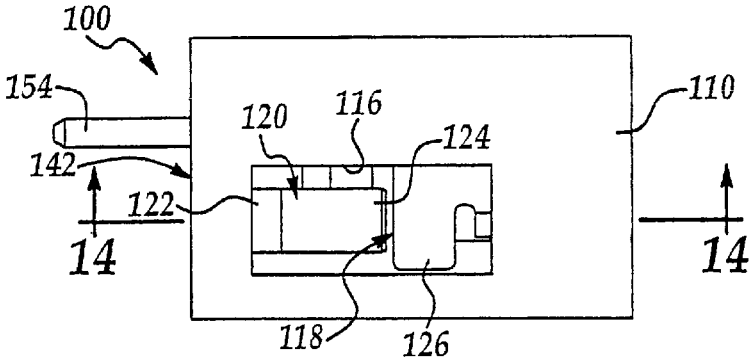
FIG. 13 is a simplified semi-diagrammatic view of a portion of row A side of the header illustrating a single cavity with a female solder-tail terminal of the invention mounted therein.
Figure 14:
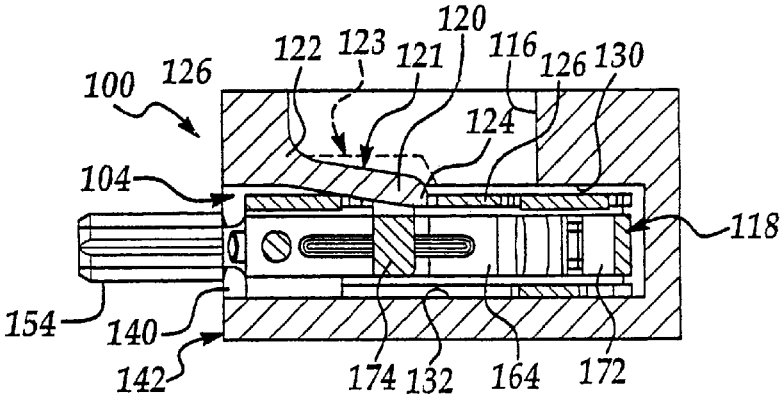
FIGS. 14 is a cross sectional view taken on the line 14—14 of FIG. 13.
Figure 15:
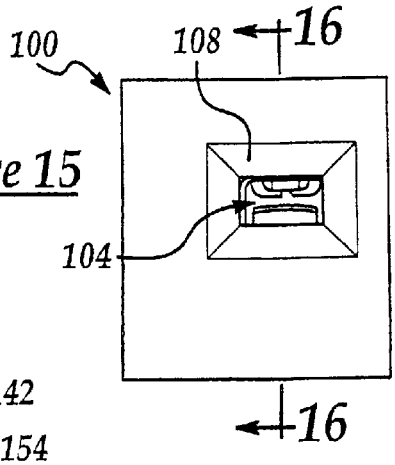
FIG. 15 is an end view of the blade receiving end of the header cavity portion shown in FIGS. 13 and 14.

As shown in simplified semi-diagrammatic form in FIGS. 13–16, the terminal receiving cavity 104 is shown with the female GT 150 soldertail terminal 118 received therein, fully inserted in assembled condition and locked in place in the cavity 104 by the header cavity spring finger 120. Opening 116 is formed by a retractable side core in the injection molding tooling which cooperates with retractable end coring used to form the main cavity 104. Thus, spring finger 120 is integrally joined at one end 122 to the main body portion of header 100 and projects substantially toward the mating face 102 (FIG. 14). Finger 120 is constructed and arranged to spring out to a flexed or retracted position or state 123 and spring back to a free or locked position or state 121 in order to capture the terminal box of each terminal 118 with only about a 0.2–0.5 mm deflection travel range in order to reliably capture the terminal 118 within the cavity 104, 106. Because the deflection of the finger 120 is minimal, the header 100 and finger 120 can be molded of a composite material containing glass fibers or of a glass-filled and reinforced plastic injection molding material (shown in FIG. 14). Side lock arm 120 is deflected outward by the leading edge and side of terminal 118 as it is being inserted telescopically into the cavity 104, 106 during initial assembly thereof into the header 100. The free end 124 of side lock arm 120 thus forms a locking spring tang which cooperates with a locking tab 126 provided on the mutually facing side of terminal 118, as best seen in FIG. 14.

Figure 16:
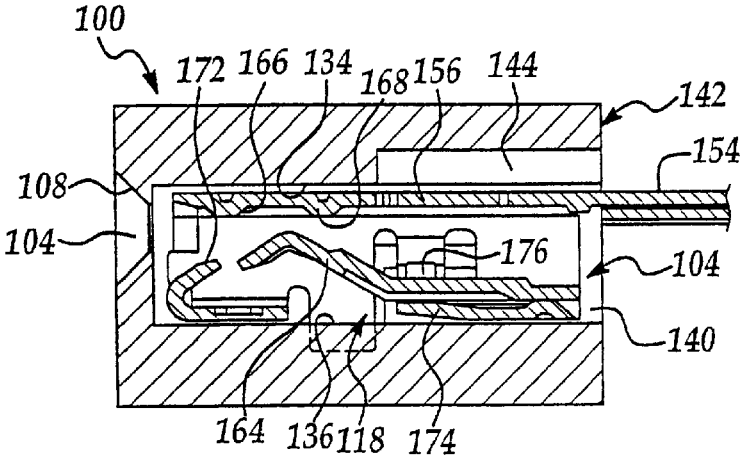
FIG. 16 is a cross sectional view taken on the line 16—16 of FIG. 15.

The interior of each header cavity 104, 106 is rectangular in transverse cross section as defined by parallel side walls 130 and 132 (FIG. 14) and parallel top and bottom walls 134, 136 (FIG. 16). Each cavity 104, 106 also has a terminal receiving opening or port 140 in the rear mating face 142 of header 100 (FIGS. 8, 14 and 16) which need not have beveled entrance edges since the terminals 118 are preassembled and locked into header 100 prior to assembly of such a pre-loaded header 100 to the associated printed circuit board.

Figure 18:
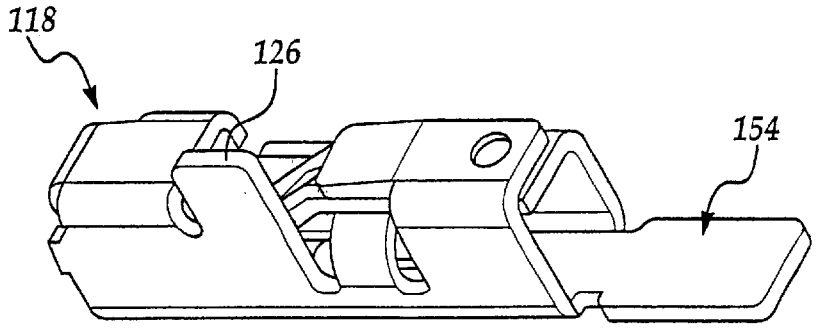
FIG. 18 is a perspective view of the improved female solder-tail terminal shown by itself constructed in accordance with the invention.
Figure 19:
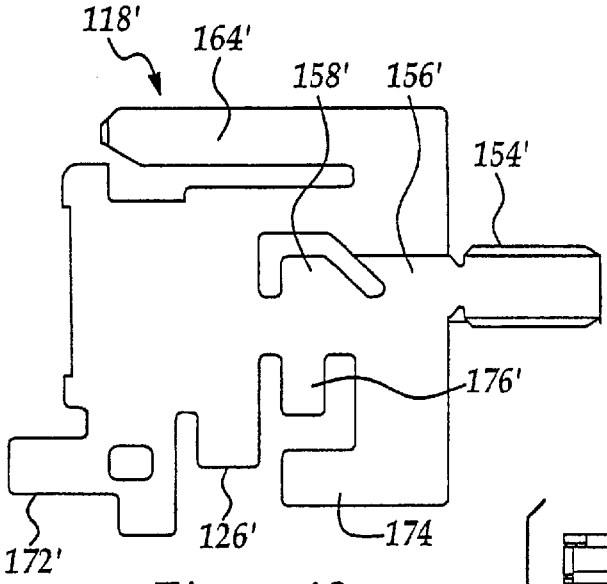
FIG. 19 is a plan view of the progressive die blanking used in forming the terminal of FIG. 18 prior to the bend forming of the same.
Figure 20:
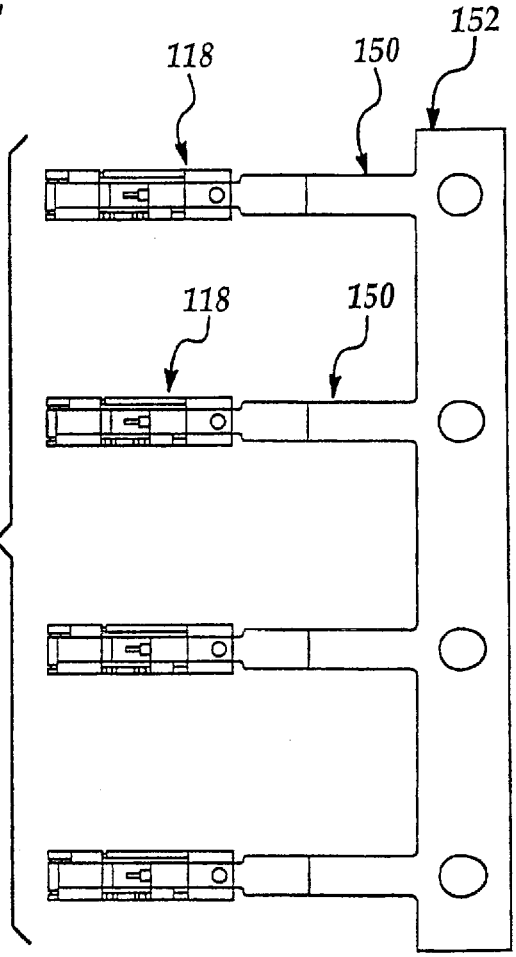
FIG. 20 illustrates a series of the terminals after die stamping and bend forming but while still attached to the leader strip of the sheet metal material from which the terminals are blanked in the progressive die forming operation.
Figure 22:
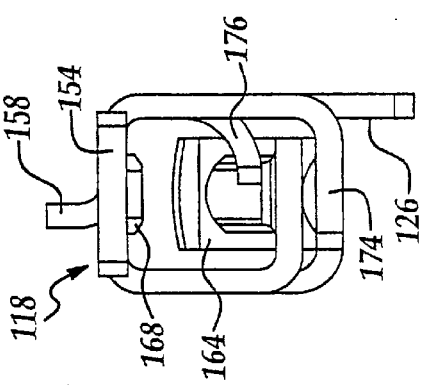
FIG. 22 is an end view looking at the right hand end of the terminal as viewed in FIG. 21.
Figure 25:
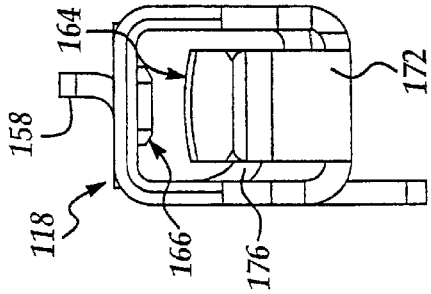
FIG. 25 is an end view looking at the right hand end of the terminal as viewed in FIG. 23.

The construction, manufacturing and structural details of the exemplary female soldertail terminal 118 are shown in detail to engineering scale in FIGS. 17–30. The outline and plan view of the die-cut terminal blanking workpiece as run in a conventional progressive die-stamping and bending machine is shown in FIG. 19 as blank 118'. FIG. 20 illustrates the blanking strip starting material after a series of four blanks 118' have been bent up into the final configuration of FIG. 18 to form the terminal 118 but prior to their severance from the associated connecting arm 150 of the die blanking leader strip 152. It will be seen that terminal 118 has an integral soldertail 154 protruding from the rear end of the terminal. As illustrated in FIGS. 13, 14 and 16, in assembly and use, soldertail 154 protrudes from the rear mating face 142 of header 100 a suitable distance to cooperate with the usual receiving openings or receptacles in the printed circuit board (not shown) to make a soldered electrical connection with the printed circuitry array provided on the printed circuit board (also not shown).

Figure 12:
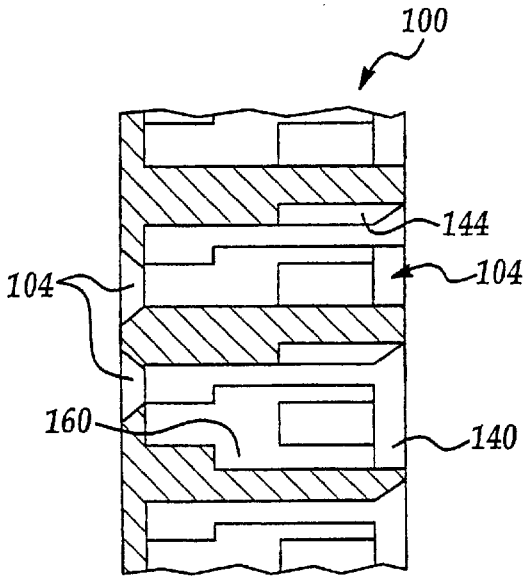

In general, the foregoing manner of constructing terminal 118 is conventional and well understood and therefore not described in further detail hereinafter. The structure of terminal 118 also will be apparent to those skilled in the art from the engineering views of FIGS. 18 through 30, which are incorporated herein by reference and not further described in detail. Suffice it to say that those features which are believed to be novel and characterize terminal 118, for purposes of the present invention, are the upwardly protruding locking tab 126 that cooperates with the flex lock arm 120 of header 100. Terminal 118 thereby omits the protruding locking tang common to prior female terminals. An additional feature of terminal 118 is the provision of the integral soldertail 154 oriented to protrude coplanar with the top wall 156 of terminal 118. Hence soldertail 154 is asymmetrically oriented relative to the longitudinal centerline axis of the terminal 118. Another feature is the stabilizing keel or fin 158 that is bent to protrude upwardly from the central area of top wall 156. Each of the header cavities 104, 106 is provided with a blind-end slot 144 (FIGS. 11, 12 and 16) that receives fin 158 as the associated terminal 118 is inserted slidably into the associated cavity. Likewise each terminal locking tab 126 registers with and slides into its own cavity slot 160, which also is a blind-end slot that opens at the terminal insertion opening or port 140 (FIG. 12). The fin 158 and tab 126 help accurately guide and stabilize terminal 118 in assembled and fully mounted position in its associated cavity 104, 106.

Figure 17:
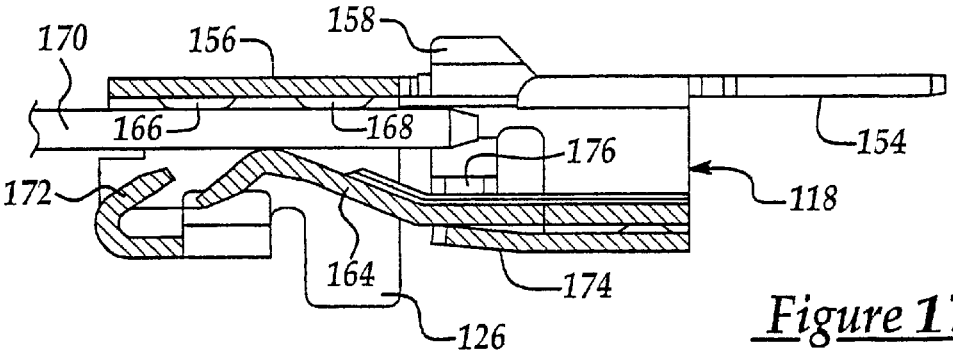
FIG. 17 is a cross sectional view of the solder-tail female terminal of the invention shown demounted by itself but operably receiving the male blade of an associated electronic module for making mechanical and electrical contact therewith.

As best seen in FIGS. 16 and 17, the interior construction of terminal 118 is conventional and includes the resilient electrical contact spring finger 164 and the downwardly struck embossments 166 and 168. These contact elements cooperate to slidably receive and make good mechanical and electrical contact with the associated blade 170 of the electrical module (not shown) that is to be plugged into header 100 in constructing the automotive electrical connection system in which header 100 is to be employed. Additional conventional features include a bent back entrance guide finger 172 to guide insertion of blade 170 into the terminal 118 after passage through the port 140. Also, terminal 118 has a slightly upwardly bent finger 174 for reinforcing contact finger 164. Finger 164 is also clamp reinforced from above by a bent-in finger 176.

Figure 24:
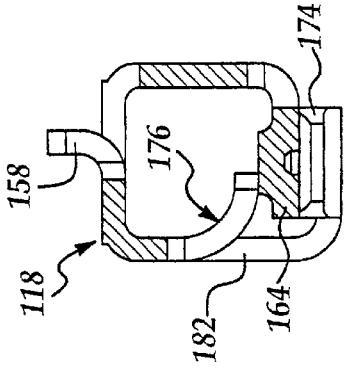
FIG. 24 is a cross sectional view taken on the line 24—24 of FIG. 23.
Figure 21:
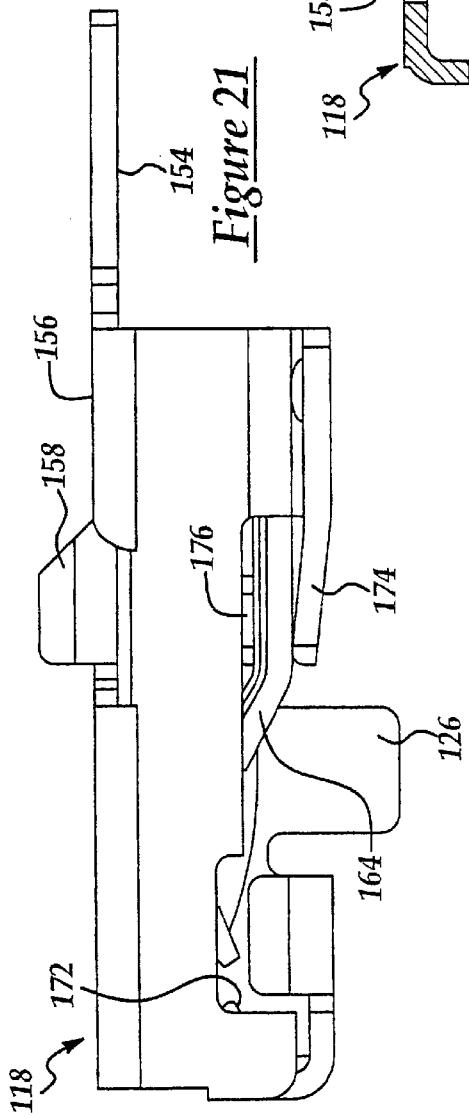
FIG. 21 is a side elevational view of the terminal shown in whole or in part in FIGS. 13–18.
Figure 23:
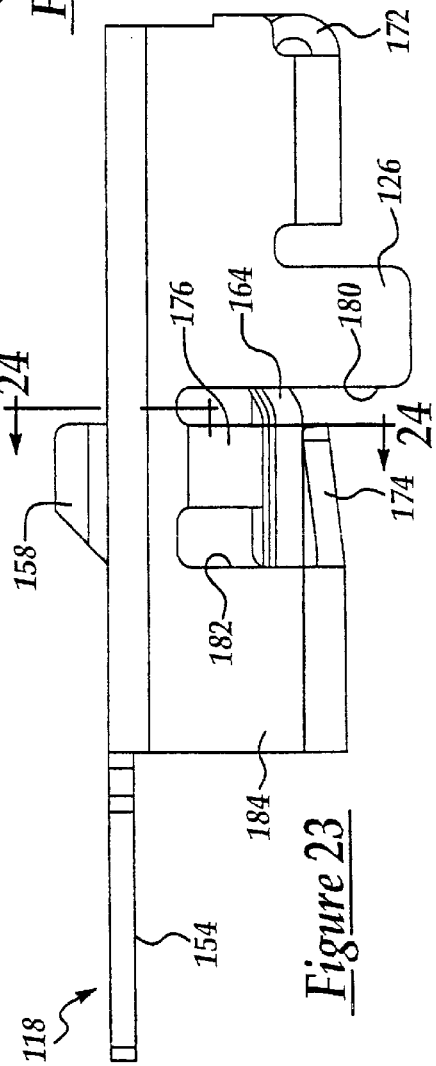
FIG. 23 is an elevational view of the side of the terminal of FIG. 21 opposite to that seen in FIG. 21.
Figure 26:
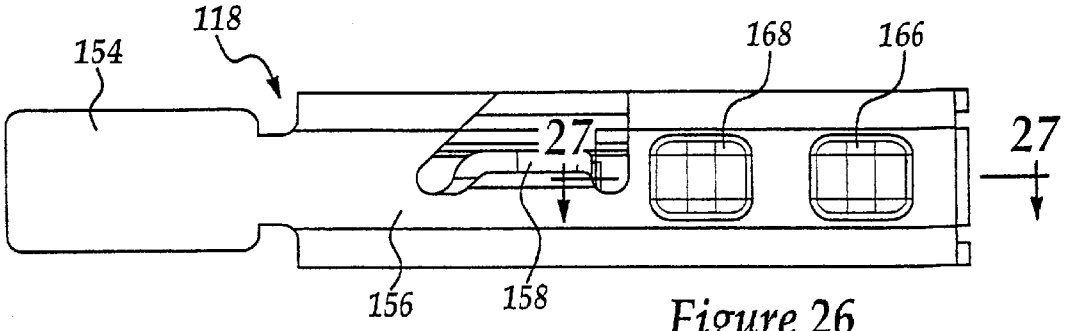
FIG. 26 is a top plan view of the terminal shown in FIGS. 17, 18 and 21–25.
Figure 27:
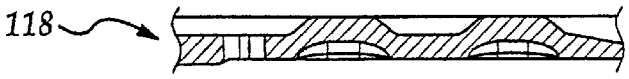
FIG. 27 is a fragmentary cross sectional view taken on the line 27—27 of FIG. 26.
Figure 28:
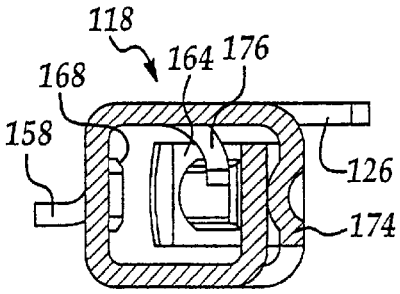
FIGS. 28 and 29 are cross sectional views taken respectively on the is lines 28—28 and 29—29 of FIG. 30.
Figure 29:
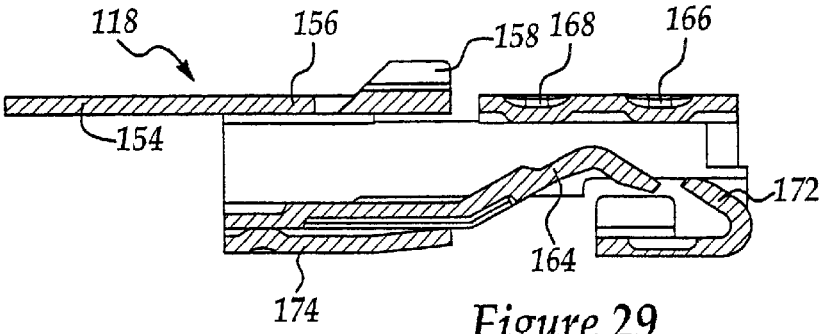
Figure 30:
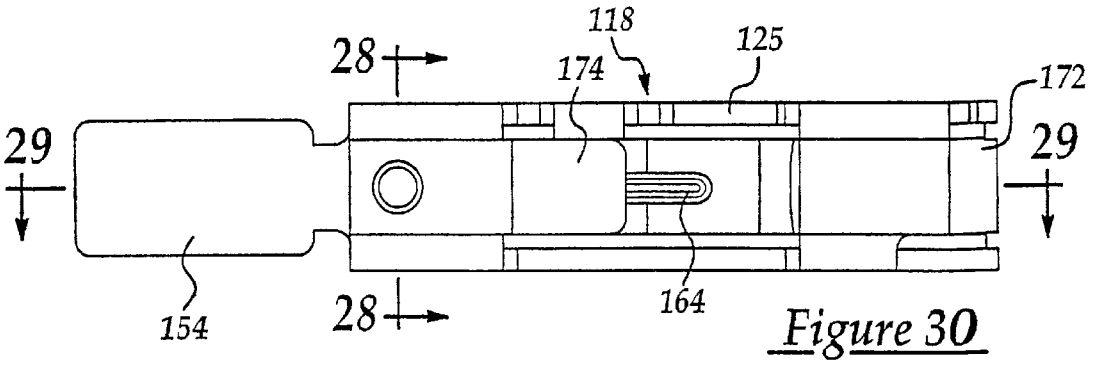
FIG. 30 is a bottom plan view of the terminal as shown in FIG. 26.

As best seen in comparing FIG. 14 with FIGS. 23 and 24, a side opening space is provided in terminal 118 located between the locking edge 180 of locking tab 126 and the facing edge 182 of a side wall 184 carrying bent finger 174. This space provides a gap into which locking edge or free end 124 of flex lock arm 120 snaps when it is clear of the side surface of the locking tab 126 during insertion of terminal 118 into its associated cavity 104, 106. The bent-in configuration of support arm 176 provides clearance for such spring-in motion of the flex lock arm free end 124 and so that the flex lock arm 118 engages the locking edge 180 of tab 126 when the connector 99 is fully assembled.

Referring again to FIGS. 1 through 11, the header 100 is provided with a pair of mounting prongs 190 and 192 respectively aligned with cavity rows A and B. Each of the header mounting prongs 190, 192 has a barb formation 194 at its free end for spring tang locking engagement with a mating opening in the associated printed circuit board (not shown) for snap-in locking of header 100 against the printed circuit board after the selected array of terminals 118 have been inserted into the associated terminal cavities 104 and 106. Thus the array of soldertails 154 protruding from the rear mating face 142 of the terminal pre-loaded header are readily inserted into corresponding openings in the printed circuit board to mate with the printed circuit array and then securely electrically connected by way of soldering thereto in a conventional fashion.

From the foregoing it will be seen that in the assemble, operation and use of cavity header 100 the associated female soldertail terminals 118 are easily but securely snap-locked individually into associated header cavities 104, 106. An improved low-profile, one-piece header design is thus provided that can be terminal pre-loaded and then quickly snapped to a mating printed circuit board (not shown) with each soldertail 154 simultaneously inserted into a corresponding receiving opening in the board. In the example shown, header 100 will mate with the blades 170 of the electrical module equipped with blade sizes 0.8×(1.2 to 1.5) mm when scaled from the drawings, and utilizing values of 0.5 mm for the aforementioned centerline spacing of cavities 104, 106 within a given row and the side-to-side lateral spacing of the cavity rows A and B. This exemplary design of header 100 allows for the 5.0 mm continuous stacked cavity centerline spacing in the two rows A and B, which is a configuration hitherto not possible with current cavity designs. Header 100 also assures a smooth lead-in for mating blades 170 of the module due to the chamfer or bevels 108 along all four entrance edges of the insertion opening 104 for guiding the associated blade 170 into each cavity. This typically is not possible unless a two-piece header design of the prior art is utilized.

The built-in flex lock arms 120 of header 100, that are made by mold tooling side-coring the header, enable terminals 118 to be locked into their associated cavity 104, 106 merely by sliding the terminal all the way into the cavity. Flex lock arms 120 are recessed within the header 118 and hence are not subject to damage by handling during inventory, shipping or manufacturing operations or during terminal assembly thereto or during installation on the printed circuit board. Header flex lock arms 120 also insure that terminals 118 are securely locked in place into header 100 for handling of the terminal pre-loaded header until final installation and soldering into the circuit board.

It is also to be noted that each header flex lock arm 120 engages one side of the associated terminal box of terminal 118, as opposed to engaging the top or bottom surfaces of the terminal box. This allows for a very small 5.0 mm top-to-bottom cavity centerline C/L spacing (FIG. 2), while maintaining a one-piece connector design in the form of header 100. This is to be contrasted with current or potential header design alternatives that are required to maintain such tight centerline spacing, such as using the aforementioned two-piece header design that must "sandwich" each of the terminals between the header pieces. Such two-piece header designs are also disadvantageous because they introduce additional tolerances into the connection system.

As indicated previously, the flex arm lock feature of header 100 is formed in the side of the header with side cores in the injection molding and tooling set-up. This eliminates the need for mold tooling for making "bypassing" core windows in the mating face 102 of the header. In addition, front mating face 102 of the header 100 provides uninterrupted lead-ins for the mating blades 170 of the module.

Another feature to note in the illustrated exemplary embodiment is that each header flex lock arm 120 is able to spring out and spring back in order to capture the terminal box of each associated terminal 118 with only a 0.2–0.5 mm deflection travel range (solid line to broken line positions shown in FIG. 14) in order to reliably capture terminal 118 in the associated cavity. This minimal deflection travel, along with the rugged design of flex lock arm 120 with a relatively thick hinged connection at 122, allows a glass-filled and reinforced plastic injection molding material to be used in the injection molding of header 100 and its integral spring arms 120, a high strength molding material that would otherwise typically cause breaks at high stress areas, which now can be avoided by utilizing the one-piece header design of the invention.

It also will be appreciated that the provision of a one-piece design of the header 100 of the connector 99, as contrasted with the aforementioned two-piece alternative, enables considerable cost savings in piece tracking and in assembly of the header connector to the circuit board and associated module. In addition, injection molding tooling cost is reduced as compared to that required for manufacturing a two-piece header design. The preferred one-piece side-lock header design of the invention also reduces the tolerance stack-up associated with the nose piece typically used with prior tangless terminals, thereby improving plastic-to-terminal alignment. The improved design of header 100 and that of the cooperative terminal 118 allows a terminal to be packaged with similar header/shroud constraints as that applicable to a symmetric two-blade style terminal, such as that manufactured by Kostal of Germany under their model MLK 1.2.

Although the disclosed example of header 100 has the cavities 104 of row A offset longitudinally from those of row B, it is to be understood that this staggered orientation is merely that required for a given electronic module construction. The cavities of row A thus can be aligned laterally with those of row B, if desired. In either event, the side flex lock arm feature eliminates the need for by-passing cores which create windows in the mating face of the header. It thus will be seen that building the flex lock arms 120 into the header 100 rather than into the terminals 118 also allows for reduction of the cavity package size while allowing tighter centerline spacing of the cavities 104, 106 and hence the terminals captured therein.

What is claimed is:

1. An electrical header connector engaged electrically between a control module and a printed circuit board, the electrical header connector being juxtaposed to a planar mounting surface of the printed circuit board, engaged electrically through a plurality of receptacles carried by the printed circuit board, and engaged electrically to a plurality of male terminals of the control module, the electrical header connector comprising:

a longitudinal axis disposed parallel to the planar mounting surface of the printed circuit board;

a plurality of female terminals, each one of the plurality of female terminals engaged electrically to a respective one of the plurality of male terminals of the control module;

a one-piece injection molded header having;

a generally rectangular cross sectional configuration taken perpendicular to the longitudinal axis, front and rear longitudinal mating faces, and opposite longitudinal side faces, the header being elongated longitudinally so as to have a high aspect ratio to thereby provide the low-profile connector when mounted with the longitudinal axis of the header connector disposed parallel to the planar mounting surface of the associated printed circuit board, a plurality of terminal-receiving cavities, each one of the plurality of terminal-receiving cavities housing a respective one of the plurality of female terminals and extending transversely to the terminal-receiving cavities communicate longitudinally through the header front end face juxtaposed to the printed circuit board, a plurality of bores carried by the header and wherein each one of the plurality of bores communicated transversely with a respective one of the plurality of cavities and communicates through the longitudinal side face of the header, and a plurality of flex lock arms engaged unitarily to the header, wherein each one of the plurality of flex lock arms project into a respective one of the plurality of cavities and is adapted to be flexed by a respective one of the plurality of female terminals when the plurality of female terminals are telescopically inserted into the plurality of cavities and then snap locked to hold the plurality of female terminals in the plurality of cavities; and wherein said terminal is provided with a protruding locking tab along one side wall and an adjacent space in said one side wall for receiving therein the free end of the flex lock arm of the associated header cavity in assembled position, said tab providing a locking abutment edge for cooperation with said free end of said flex lock arm in locked position.

2. The header connector of claim 1 wherein said flex lock arms are recessed within said header body and hence are not subject to damage by handling during inventory, shipping or manufacturing operations or during terminal assembly thereto or during installation on the printed circuit board, said lock arms also being constructed and arranged to insure that the terminals are securely locked in place into said header for handling of the terminal pre-loaded header until final installation and soldering into the circuit board.

3. An electrical header connector comprising:

an elongated terminal having a leading end cross section, a tab, and a space communication laterally outward;

an elongated header having a longitudinal axis, a front mating face and a rear mating face, the front and rear mating faces disposed parallel to the longitudinal axis;

a cavity carried by and extending through the header between the front and rear mating faces and disposed perpendicular to the longitudinal axis, the terminal being disposed within the cavity;

a receiving port carried by the rear mating face and communicating with the cavity, the receiving port defining a cross section equal to the leading end cross section of the terminal;

a bore carried by the header and communicating with the cavity, the bore being disposed perpendicular to the cavity;

an elongated flex lock arm engaged unitarily to the header, disposed between the front and rear mating faces and projecting toward the front mating face, the flex lock arm having an engaged end, a free end, a retracted position and a locked position, the engaged end being engaged unitarily to the header within the bore, the free end disposed within the cavity when the flex lock arm is in the locked position and disposed within the bore when the flex lock arm is in the retracted position, wherein the flex lock arm is resiliently flexed from the locked position to the retracted position when the terminal is inserted through the rear mating face, and wherein the free end snaps into the space of the terminal back into the locked position when the terminal is fully inserted into the cavity; and wherein said terminal is provided with the protruding locking tab along one side wall and the adjacent space in said one side wall for receiving therein the free end of the flex lock arm of the associated header cavity in assembled position, said tab providing a locking abutment edge for cooperation with said free end of said flex lock arm in the locked position.

4. The electrical header connector set forth in claim 3 wherein the header is made of a glass filled material.

5. The electrical header connector set forth in claim 4 wherein the header is a molded, one-piece, unitary design.

6. The electrical header connector set forth in claim 3 comprising:

the combination of the terminal, the cavity, the receiving port, the bore, and the flex lock arm being a cell; and the cell being one of a plurality of cells aligned in a row disposed parallel to the longitudinal axis of the header.

7. The electrical header connector set forth in claim 6 wherein the row is one of two rows aligned side-by-side and parallel to one another.

8. The electrical header connector set forth in claim 7 wherein the terminals of the plurality of cells are engaged electrically between an electronic module and a printed circuit board.

* * * * *